United States Patent [19]

Meyle et al.

[11] Patent Number: 4,639,230

[45] Date of Patent: Jan. 27, 1987

[54] APPARATUS AND METHOD FOR SHADOW MASK INSERTION

[75] Inventors: William H. Meyle, Naperville; Paul H. Wendt, Northlake, both of Ill.

[73] Assignee: Zenith Electronics Corporation, Glenview, Ill.

[21] Appl. No.: 172,330

[22] Filed: Jul. 25, 1980

[51] Int. Cl.[4] ..... H01J 9/00

[52] U.S. Cl. ..... 445/30; 445/68

[58] Field of Search ..... 29/25.15, 25.19, 25.13; 445/30, 68

[56] References Cited

U.S. PATENT DOCUMENTS

| | | | |
|---|---|---|---|
| 3,224,755 | 12/1965 | Schweitzer | 269/257 |
| 3,838,483 | 10/1974 | Barawski et al. | 29/25.15 |
| 3,899,812 | 8/1975 | Barawski et al. | 29/25.19 |
| 4,130,919 | 12/1978 | Oyama | 29/25.19 |
| 4,138,774 | 2/1979 | Oyama | 29/25.19 |
| 4,164,060 | 8/1979 | Hartta | 29/25.19 |
| 4,188,695 | 2/1980 | Oyama | 29/25.19 |
| 4,322,876 | 4/1982 | Schmidt et al. | 29/25.19 |

FOREIGN PATENT DOCUMENTS

| | | | |
|---|---|---|---|
| 0008467 | 6/1979 | European Pat. Off. | 29/25.19 |

*Primary Examiner*—John McQuade

*Attorney, Agent, or Firm*—Cornelius J. O'Connor; Thomas E. Hill

[57] ABSTRACT

Apparatus and method are disclosed for use in the manufacture of a color cathode ray picture tube, the apparatus providing for inserting a shadow mask into the face panel of the tube. Means are disclosed for seeking the apertures of the leaf-type springs extending from the frame and locating the axes of the apertures and locking the apertures at predetermined points in a first substantially horizontal plane. The stud-locating means include V-groove tip means for locating, positioning and cradling the studs in the second plane with the axes of the studs in approximate vertical alignment with the predetermined points. Elevator means provide for raising the mask to an upper assembly position to translate the planes into approximate coplanarity, and bring the axes of the apertures into approximate coincidence with the axes of the studs before release of the springs. Dimensional deviations of the mask and panel are nullified by locking the axes of the apertures and cradling the studs in approximate coaxial coincidence for positive consistent and unequivocal mutual engagement of the mask with the panel.

2 Claims, 15 Drawing Figures

APPARATUS AND METHOD FOR SHADOW MASK INSERTION

BACKGROUND OF THE INVENTION AND PRIOR ART DISCLOSURES

The present invention relates generally to production apparatus used in the manufacture of color cathode ray picture tubes, and is particularly directed to improved means for automatically inserting a shadow mask into a face panel for engagement therewith.

With reference to FIG. 1, there is shown a mask assembly 10 oriented and aligned for insertion into a substantially rectangular face panel 12 including a rearwardly extending flange 13 with a plurality of inwardly extending studs 14, indicated as comprising three studs. Mask assembly 10 consists of a foraminated mask 15 which provides for color selection. The mask 15 is mounted on a rigid frame 16. A plurality of leaf-type suspension springs 18 equal in number to the studs 14 are spaced about the periphery of frame 16 for suspending mask 15 in precise adjacency to panel 12. Two of the springs are shown in this example as being located on opposing sides of the mask assembly 10, with the third spring located on an adjacent side. Four suspension springs 18 located on opposing sides of the frame may as well be used. One end of each of the springs 18 extends from the frame 16 in permanent attachment to the frame as by welding. The distal ends of the springs 16 have apertures 20 for detachably engaging associated ones of the studs 14. Face panel 12 has a phosphor-screen-bearing surface on the inner side thereof.

FIG. 2 shows the mask assembly 10 inserted into face panel 12 and detachably engaged thereto. The apertures 20 of the springs 18 are indicated as being engaged with associated studs 14. Engagement and disengagement of springs 18 with associated studs 14 is by movement of the distal ends of the springs 18 toward and away from the tube axis. When inserting and engaging the mask assemby 10 with the face panel 12, springs 18 must first be depressed toward frame 16. Each spring aperture 20 must be in alignment with the associated stud 14 before springs 18 can be released to provide engagement of the spring apertures 20 with the studs 14.

The perforations of shadow mask 15 may, in one common configuration, comprise a pattern of vertical perforations 28, shown schematically and greatly enlarged in FIG. 2, with a registered pattern of phosphor stripes 30, also shown greatly enlarged, deposited on inner surface 22 of face panel 12. The phosphor stripes 30 are excited to luminescense by electron beams projected by a plurality of electron guns which may comprise a triad of guns located in the neck region of the cathode ray tube envelope (not shown). The phosphors comprise red-light-emitting, green-light-emitting, and blue-light-emitting compositions, each of which is excited by an associated beam which falls upon the proper phosphor pattern in passage through the perforations 28 of shadow mask 15.

The well-known process of successive application of color phosphors and other screening fluids to the screen-bearing surface 22 of the face panel 12 requires that the shadow mask assembly 10 be removed and inserted in proper registration with the face panel 12 and associated phosphor stripes 30 several times during manufacture. Although the mask can be inserted into and removed from the face panel manually, it is far more efficient to perform the operation by an automatic apparatus. By its nature, such an apparatus is quicker, more positive in operation, and is less likely to damage the face panel and/or the mask in the mask insertion operation. Also, foreign matter such as human hair and airborne dust is less likely to fall onto critical areas of the mask or panel. The presence of such foreign matter in active areas of the face panel assembly can result in rejection during final testing of the cathode ray tube of which the assembly is a part.

As has been noted, for a successful insertion, the suspension spring apertures 20 must be brought into alignment with the studs 14 before the springs 18 can be released to make engagement with the studs. A major constraint in the design of automatic shadow mask inserters are the unpredictable deviations in the dimensions of both the suspension system of the shadow mask and the stud locations which have, precluded positive, consistent and unequivocal engagement of apertures with studs. The deviations may be as much as 0.050 inch in the suspension system and 0.075 inch in the studs for a 19-inch cathode ray tube. The dimensional deviations of the mask for example have their origin in differences of the length of springs, spring curvatures, shadow mask frame dimensions, and the relatively imprecise location of the points of attachment of the springs with respect to the shadow mask frame. As a result, there is no reliable reference location on the mask assembly from which to determine the location of the spring apertures. Due to the potential for buildup in production tolerances, it cannot be assumed that either the spring apertures or the studs are located at predetermined fixed points. A condition of mis-alignment may result wherein at least one spring aperture may entirely escape engagement with its associated stud. When this occurs, it usually becomes necessary to stop the production line; the cost of such stoppage may be as much as $100 per minute of down time. Further, if the mis-engagement is not detected at the mask-inserter station, the defective assembly may continue down the production line to some station where the mask may actually fall out of the panel and damage the mask-panel assembly and/or the production apparatus itself.

Because of the unpredictable deviations in dimensions and the potential buildup of tolerances consequent thereto, the design and fabrication of reliable mask-inserter apparatus has been fraught with problems. The mask-inserter apparatus may, for example, successfully insert the mask into the panel 999 times out of 1,000. The seemingly high reliability is totally unacceptable because it may mean that it will be necessary to stop the production line as many as forty times during a 24-hour period. Achieving a cost-effective level of reliability has hitherto been difficult to the point of insurmountability in the design of mask inserters.

U.S. Pat. No. 3,899,812, Baranski, et al, of common ownership herewith, discloses automatic apparatus for inserting a CRT mask into its mating panel. Means are included which are intended to align the shadow mask such that the mask alignment holes are positioned at the points which lie in a substantially horizontal hole reference plane with each hole positioned at a predetermined location. Means are provided for engaging the panel studs and aligning the panel by means of the studs to a position where the studs are located at points which lie in substantially horizontal stud reference plane. The studs are at a location within that plane which places each stud in vertical alignment with and at a predetermined distance of its corresponding shadow mask alignment hole. With the shadow mask and its panel in positions of alignment, the mask springs are depressed to permit insertion of the mask assembly into the panel. The mask is then raised to the predetermined distance between the hole reference plane and the stud reference plane, and the springs are released to permit engagement between each stud and its corresponding alignment hole. Stud-locating fingers, and hole-locating pins, are intended to provide for mutual positioning of the panel and the mask, respectively, in the corresponding reference planes. U.S. Pat. No. 3,838,483, also to Baranski, et al, also of common ownership herewith, describes a method for inserting a CRT mask into its mating panel by means of the apparatus set forth in the aforedescribed '812 patent.

In U.S. Pat. No. 4,188,695 to Oyama, there is disclosed mask-inserter apparatus wherein means are provided for detecting an inserted shadow mask that is incompletely fitted, due to failure of one or more of the suspension springs to engage the associated stud. The apparatus comprises panel height-variation-detection means for detecting height variations in different portions of the mask when the shadow mask is incompletely fitted to the panel. The height variation detection means consist of photo-switches, limit switches, or proximity switches.

In U.S. Pat. No. 4,130,919, Oyama discloses an apparatus for removing a shadow mask assembly from a panel, and inserting the mask into a dummy panel. The dummy panel provides for the protective storage or shipment of the mask. The apparatus includes means for mo ing the mask-panel assembly to a work station, depressing the suspension springs that detachably engage the mask to the panel, transporting the panel from the station, removing the mask from the panel, and inserting the mask into the dummy panel. The suspension springs are depressed by pawls which bend the springs for disengagement of the mask from the panel. The apparatus can be designed to process mask-panel assemblies having suspension means located on three sides, or on four sides of a mask. There is no requirement for the precision engagement of the mask with the dummy panel typical of the mask-face panel assembly means described herein.

U.S. Pat. No. 4,164,060 to Hartta discloses an apparatus for assembling a shadow mask and panel of a television receiver picture tube. The apparatus is provided with separate supports for the mask and panel, with one of the supports being made as a "floating plate" movable relative to the other fixed support parallel to its plane and also perpendicularly to the plane. In addition, the floating plate is rotatable around an axis perpendicular to a plane. It is reputed that while the mask and panel may be positioned only roughly in register on the apparatus, the mechanical moving of the floating plate brings the mask and panel in such a relative position that their fixing members automatically engage each other.

OBJECTS OF THE INVENTION

It is a general object of this invention to provide automatic apparatus and method for inserting a color cathode ray tube shadow mask into its mating front panel.

It is a more specific object of this invention to provide apparatus and method capable of effecting rapid and precise automatic mask-to-panel insertion while compensating for a buildup of dimensional deviations in both the panel and shadow mask assembly.

It is a specific object of the invention to provide apparatus and method according to the invention having a manufacturing reliability of the order of 99.999%.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENTS

Figure 1:
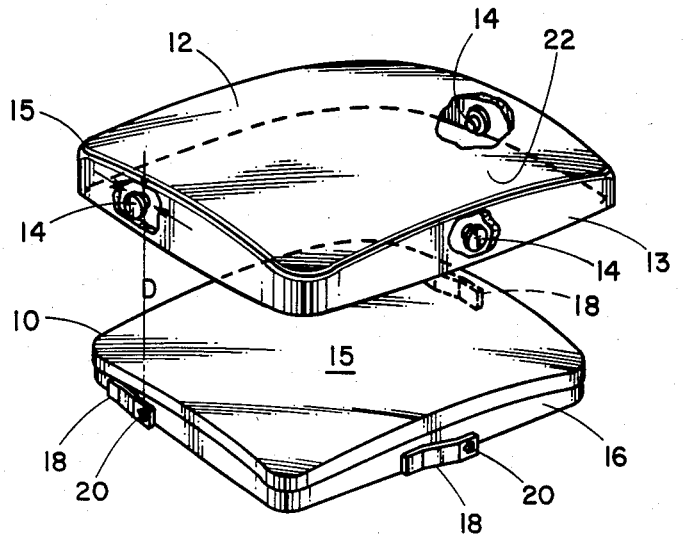
Fig. 1 PRIOR ART
FIG. 1 depicts in perspective a shadow mask exploded from a face panel, and shows certain features thereof useful in the exposition of the present invention.
Figure 2:
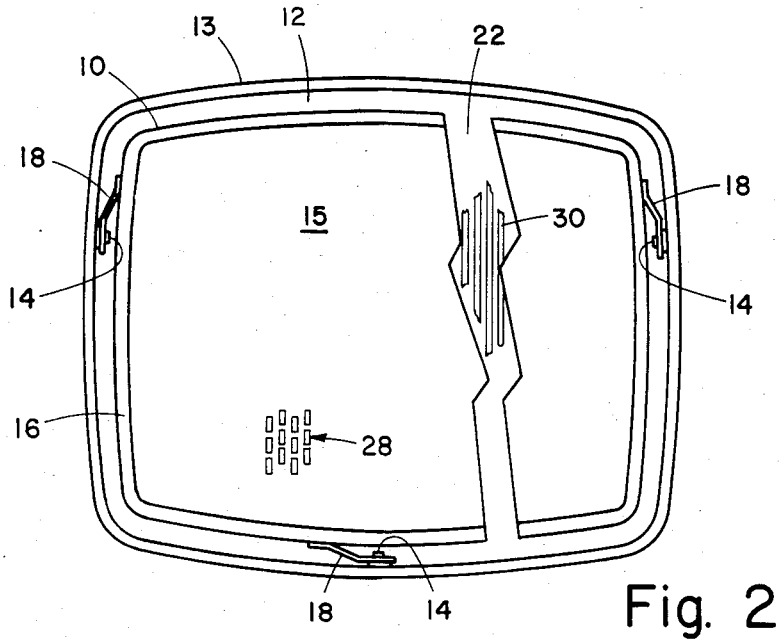
Fig. 2 PRIOR ART
FIG. 2 is a plan view showing diagramatically the engagement of a shadow mask with a face panel.
Figure 4:
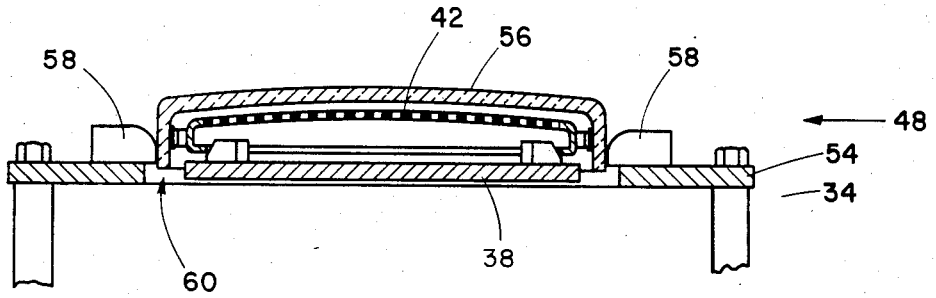
FIG. 4 depicts such a conjunction.
Figure 3:
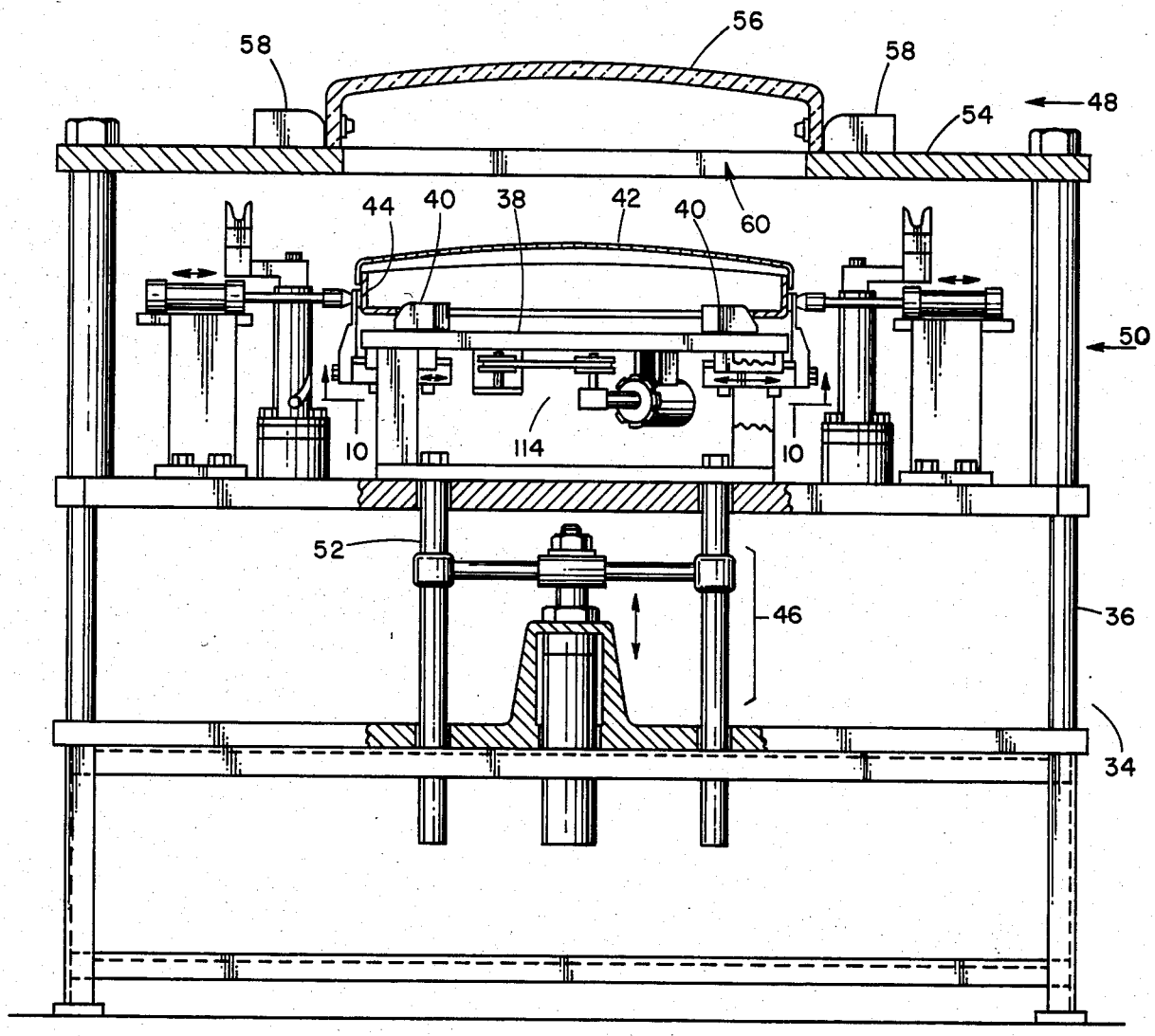
FIG. 3 is a view in elevation of a mask inserter apparatus according to the invention partially in cross-section, and depicting the elevator means by which a shadow mask is brought into conjunction with a face panel for engagement therewith.

Apparatus for use in the manufacture of a color cathode ray picture tube for inserting a shadow mask into a face panel according to the invention is shown by FIGS. 3 and 4. The apparatus 34 is indicated as comprising a main frame 36 for support of the components of the apparatus. Platen means 38 with mask-frame prelocating means 40 provide for receiving and approximately prelocating shadow mask 42 convex-side-up on platen means 38, as indicated. Mask-frame prelocating means 40 are depicted as comprising blocks having tapered faces for accepting the frame 44 of mask 42. Elevator means 46, indicated as being a pneumatic cylinder, could as well comprise cam means. Included in the elevator mechanism are plurality of elevator guide members 52 for maintaining platen means 38 in proper vertical alignment as it is raised and lowered between the upper assembly position 48 and lower, pre-assembly position 50.

Table means 54, in upper assembly position 48, provides for receiving the substantially rectangular face panel 56 of the picture tube convex-side-up with respect to mask 42. Blocks 58 provide for approximately prelocating panel 56 with respect to mask 42. Table means 54 is shown as having an opening 60 for receiving platen means 38 in approximate coplanarity when platen means 38 is raised by elevator means 46 to upper assembly position 48.

Figure 5:
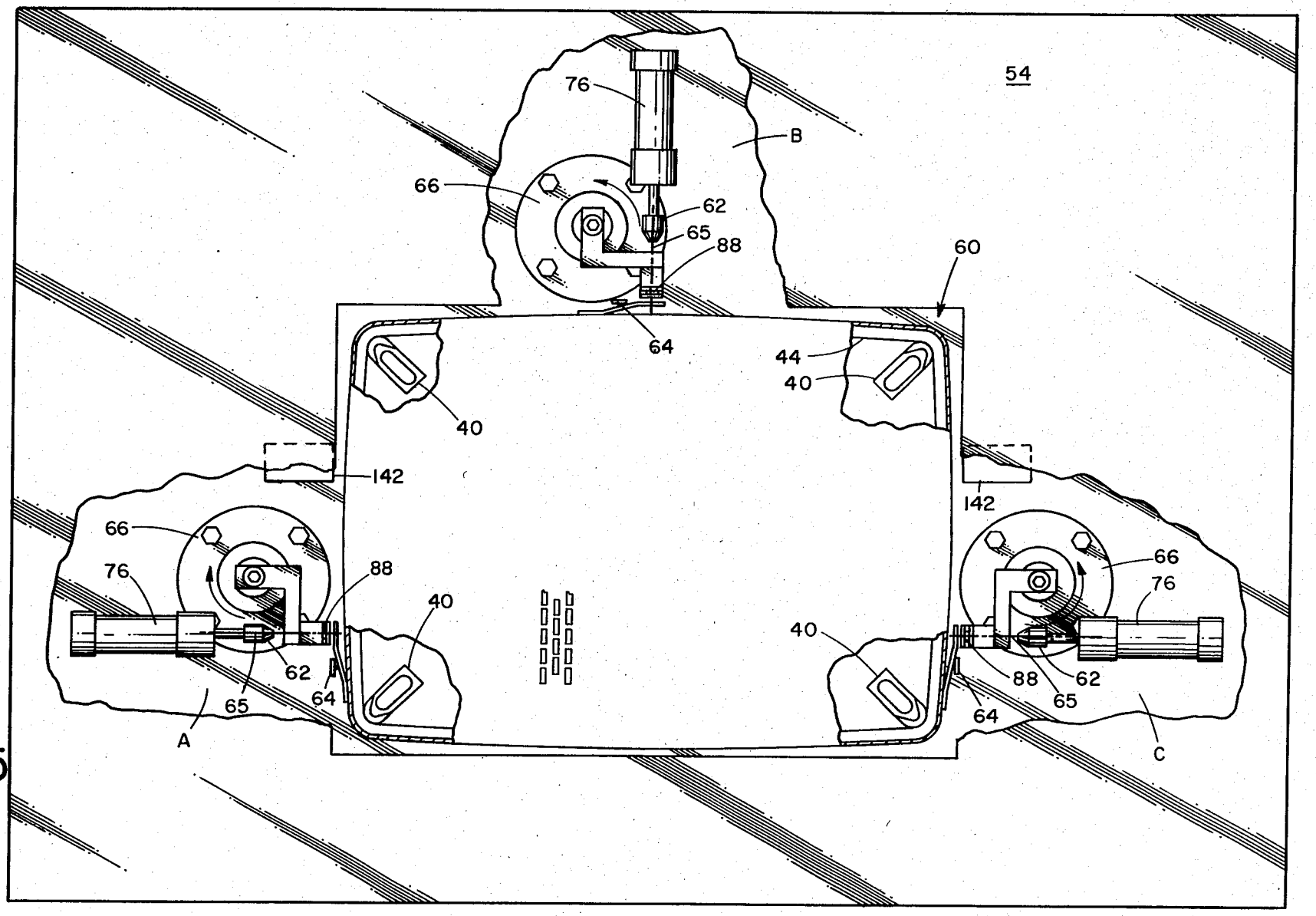
FIG. 5 is a plan view partially cut away to show the location and approximate relationship of the essential means for accomplishing the objectives of the invention.
Figure 6:
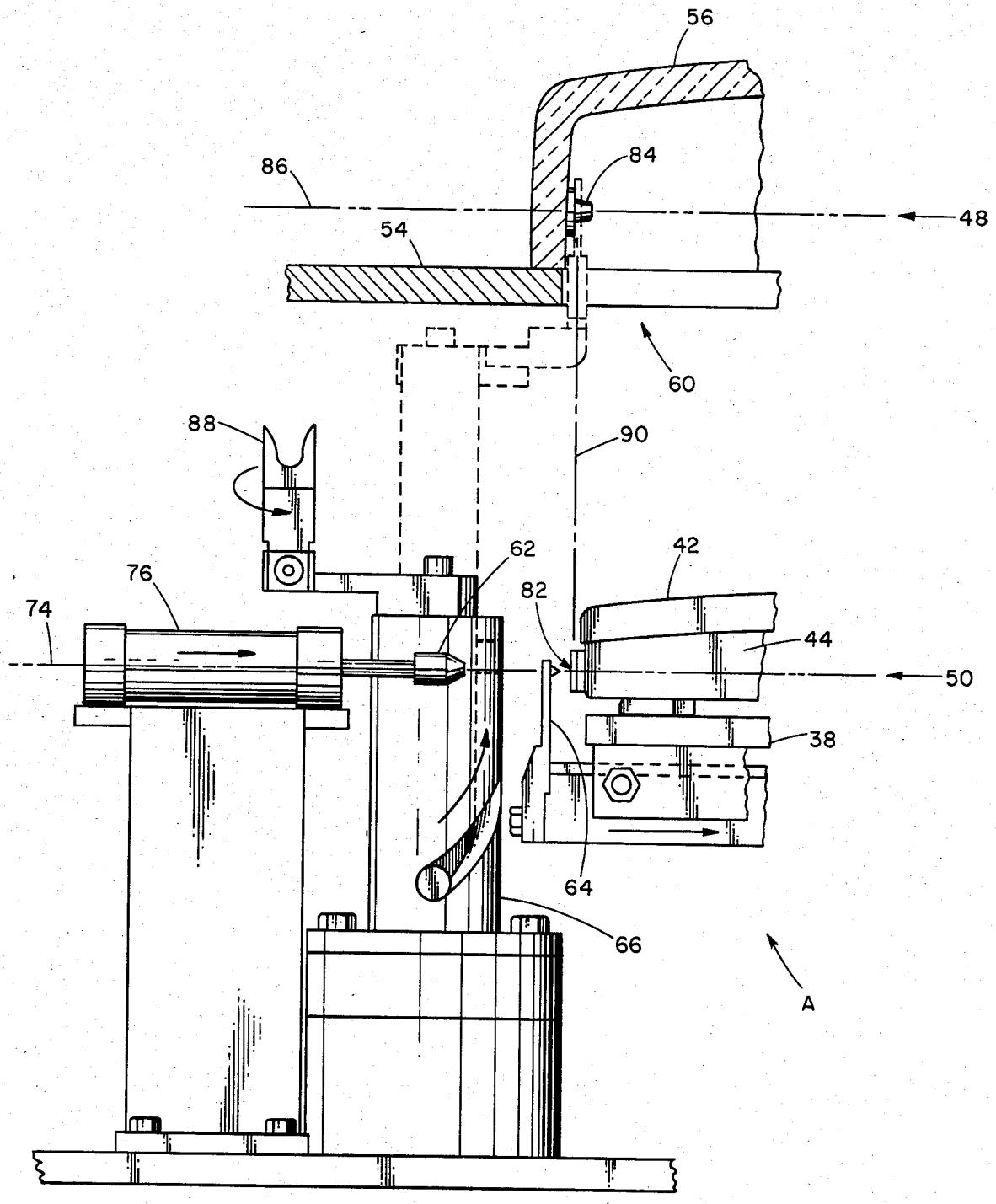
FIG. 6 is a partially sectioned elevational view depicting in greater detail one representative group of the essential means shown in FIG. 5 by which the shadow mask and panel are manipulated according to the invention.
Figure 7:
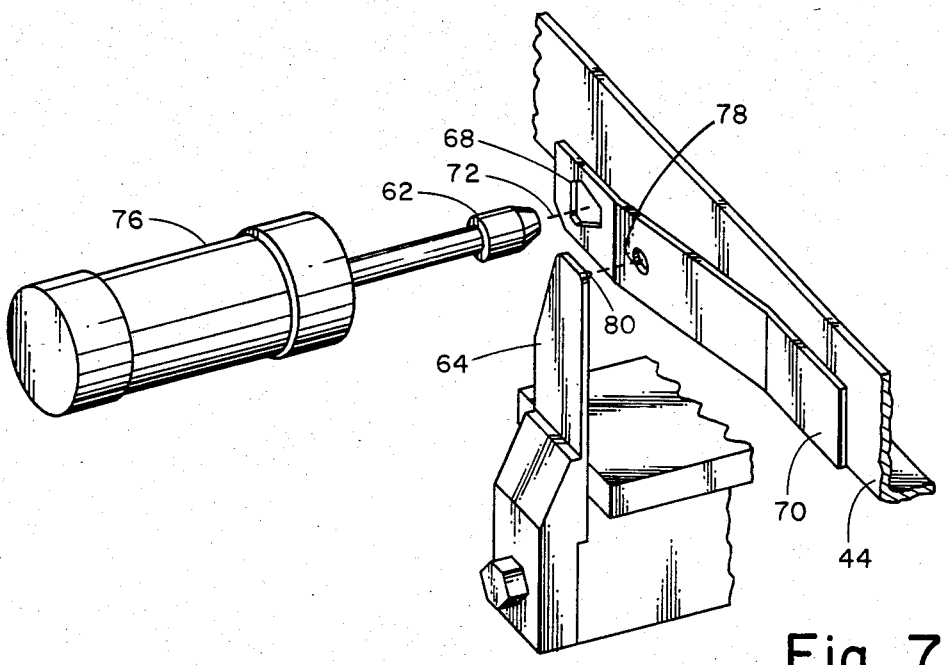
FIGS. 7 and 7A are perspective views depicting the means of manipulation of shadow mask suspension components according to the invention.
Figure 7A:
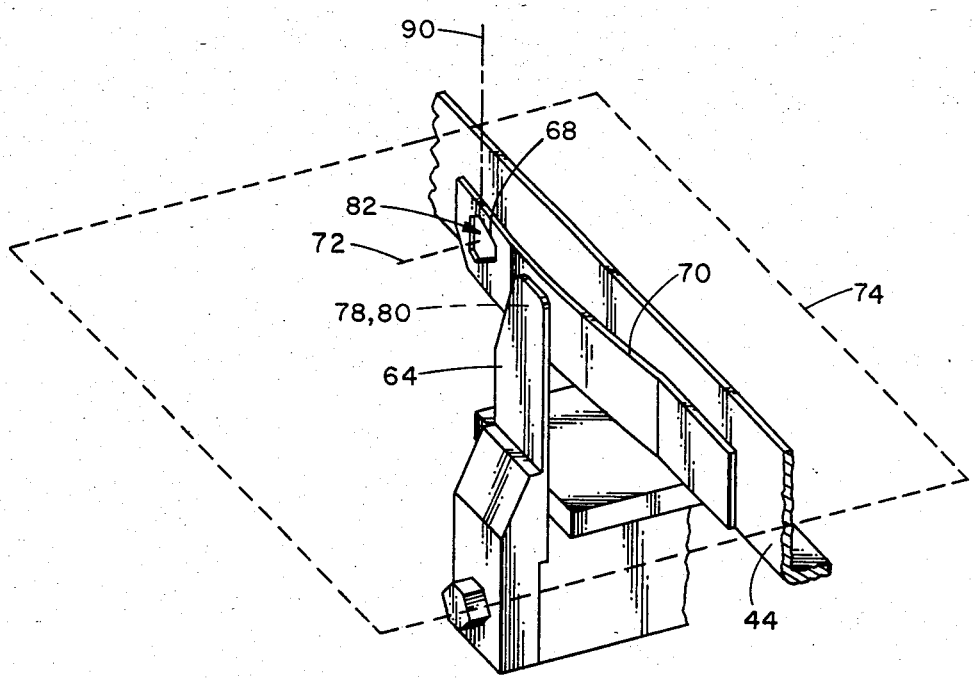
Figure 8:
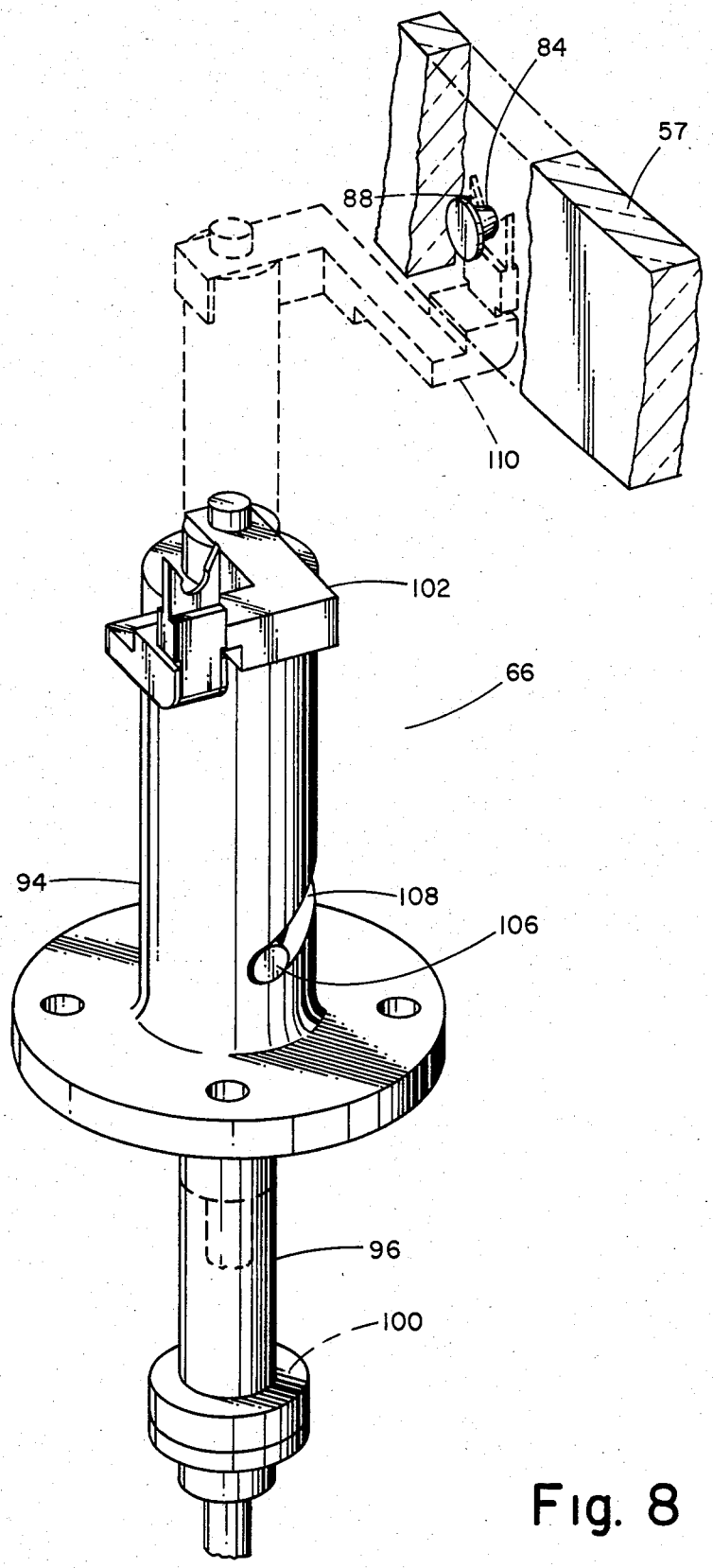
FIG. 8 is a view in elevation and in perspective depicting a panel stud-locating means according to the invention.

Means are provided in the lower, pre-assembly position 50 for preparing mask 42 for engagement with panel 56. FIG. 5 is a plan view of table means 54 partially cut away to reveal three groups of very similar components—groups A, B and C, each group comprising tapered pin means 62, spring depressor means 64 and stud-locating means 66. FIG. 6 provides a detail view in elevation of the essential components of group A, which are representative of components in groups B and C. FIGS. 7, 7A and 8 provide detail perspective views of the components described in the following paragraphs. The actions of the components of groups A, B and C are considered as being essentially identical, and as the following description of group A applies as well to groups B and C, the reference numbers are identical.

With specific reference to FIGS. 6 and 7, means at the lower, pre-assembly position 50 include tapered pin means 62 which provides for seeking aperture 68 which is situated at the distal end of spring 70 in a first, substantially horizontal plane 74, as indicated by FIG. 7. The aperture 68 provides for detachably engaging the associated stud which extends inwardly from the rearwardly extending flange 57 of the face panel 56, as will be shown. Means for moving tapered pin means 62 into and away from engagement with aperture 68 may comprise a pneumatic cyclinder 76, as indicated.

Spring depressor means 64 provide for depressing spring 70 toward mask frame 44. Spring 70 is shown as having an indent, preferably comprising a 125 mil hole 78 in the spring, adjacent to aperture 68. Spring depressor means 64 includes detent means 80 for mating with indent means 78 to lock aperture 68 when depressor means 64 is fully closed at a predetermined point 82 in the first, substantially horizontal plane, 74. The effect of the action of spring depressor means 64 is indicated by FIG. 7A, wherein spring 70 is shown as being depressed into close proximity to mask frame 44. Aperture 68 is thus locked at a predetermined point 82 in the first substantially horizontal plane 74 as indicated schematically by FIG. 7A.

Stud locating means 66 is depicted in FIG. 6 and in a greater detail in FIG. 8. The means 66 provides for establishing studs 84 of panel 56 in substantially horizontal second plane 86 in the upper assembly position 48. Stud-locating means 66 includes V-groove tip means 88 for locating, positioning and cradling the stud 84 in approximately vertical alignment with predetermined point 82. The approximate vertical alignment is indicated in FIG. 6 by broken line 90 which extends upwardly from predetermined point 82 to intersect with the axis of stud 84 (the stud axis is coincident with the line indicating second plane 86). The stud-locating mechanism, which provides for proper excursion of the V-groove tip means in locating, positioning and cradling stud 84, is shown as comprising a base and upright 94 through which project a rotatable and extensible shaft 96. The lower end of shaft 96 is caused to move upwardly by a pneumatic cyclinder, for example. The piston of the cyclinder is indicated as being attached to shaft 96 by means of a thrust bearing 100 which allows shaft 96 to rotate freely during its extension and retraction. An arm 102 is attached to the end of shaft 96 that projects from the top of upright 94. V-groove tip means 88 is in turn attached to arm 102.

Reference again to FIG. 6 in conjunction with FIG. 8 is suggested to facilitate understanding of the action of the stud-locating means 66. As shaft 96 moves upward to response to pressure from the pneumatic cyclinder, shaft 96 is caused to rotate inwardly, as indicated. Rotation is in response to cam follower 106, which is attached to shaft 96. Cam follower 106 follows groove cam 108 in the upward and downward excursion of shaft 96. The inward-upward path of the V-groove tip means 88 culminates in the positioning of arm means 102 and tip means 88 as depicted by dash-line configuration 110. It will be seen that the mechanism provides for moving the V-groove tip means 88 out of the way when the stud-locating means 66 is not in use.

Means comprising elevator means 46 provide for translating the mask 42 to the upper assembly position 48 to bring first and second planes 74 and 86 into approximate coplanarity. The axes of the apertures 68 are thus brought into approximate coincidence with the axes of studs 84.

Figure 9A:
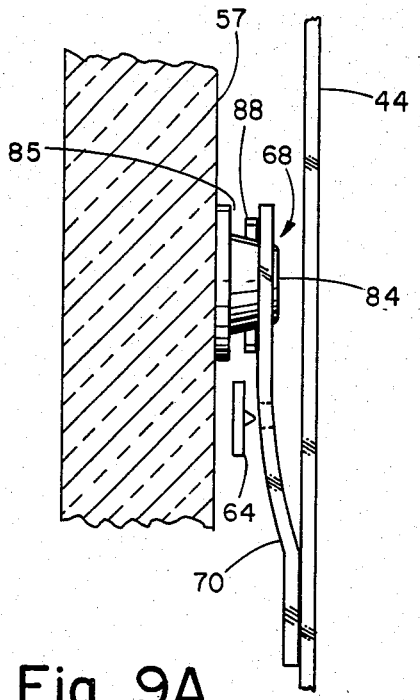
FIGS. 9A and 9C are views in elevation and partially sectioned showing the relationship and actions of mask-suspension components according to the invention.
Figure 9C:
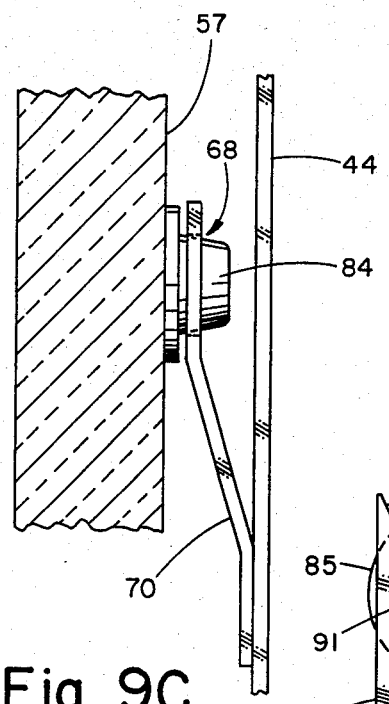

Means are provided for releasing spring depressor means 64 to cause spring 70 to rest against V-groove tip means 88 and in partial engagement with stud 84. The result is depicted in FIG. 9A. It will be observed that V groove tip means 88, while permitting partial engagement of spring 70 with stud 84, does not contact the rear face 85 of stud 84. If such a contact were made, the stud 84 could not be properly aligned.

Figure 9B:
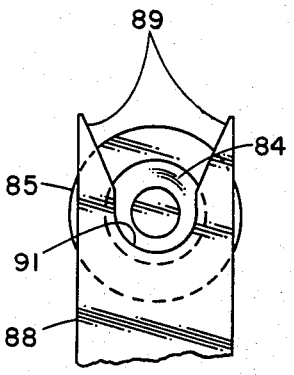
FIG. 9B is a view in elevation of a detail of components depicted in FIGS. 9A and 9C.

The configuration of V-groove tip means 88 is shown in greater detail in FIG. 9B, wherein the V-groove 89 provides for locating and positioning stud 84, and cradle means 91 provides for cradling stud 84.

It will be noted from FIG. 9A that spring depressor means 64, after releasing and unlocking spring 70, is in a "mid-position" with respect to flange 57 and spring 70. The means for causing the excursion of spring depressor means 64 from fully open position, through mid-position, to fully closed, is described infra. Upon partial engagement of spring 70 with stud 84, spring depressor means 64 is withdrawn by lowering of platen means 38 by elevator means 46.

It will be observed that spring 70 rests against V-groove tip means 88 in partial engagement with stud 84, according to the invention. The V-groove tip means 88 are then withdrawn to uncradle the stud and effect the full engagement of the spring with the stud. By this means according to the invention, the dimensional deviations of the shadow mask and panel are nullified by locking the axes of the apertures by the indent-detent means, and cradling the studs by the cradle means in approximate coaxial coincidence to provide positive, consistent and unequivocal mutual engagement of the apertures with the studs, and mask with panel.

Reference again to FIG. 5 will show how approximate coincidence of apertures and studs is established. It will be seen that the center line 65 of each tapered pin means 62 is coincident with the center of the V-groove tip means 88 when the V-groove tip means establish and cradle the studs 84 in the second plane 86. The tapered pin means 62 seek the spring apertures, raising and moving the mask 42 as necessary. The spring depressor means 64 lock the apertures 68 at the predetermined points 82 in the first plane 74. When the mask is raised to the upper assembly position 48, the coincidence of the axes of the apertures and the studs is established.

Figure 11A:
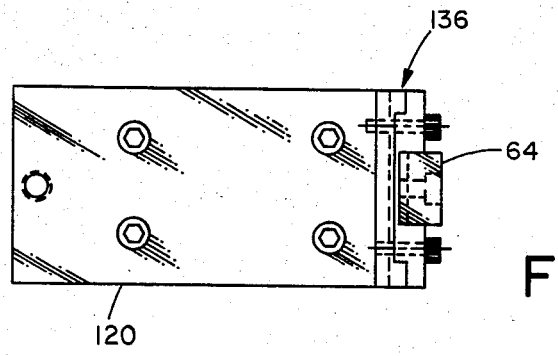
Figure 11B:
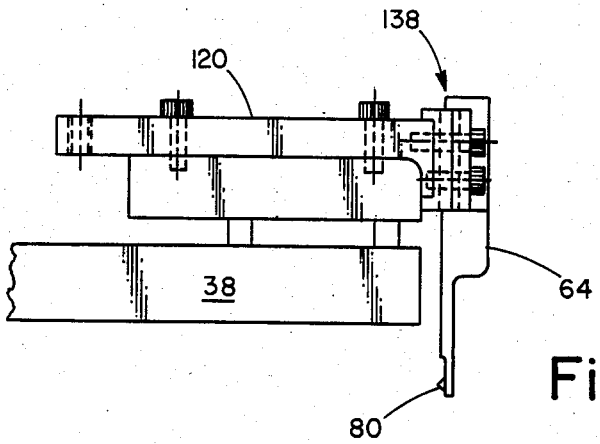
Figure 10:
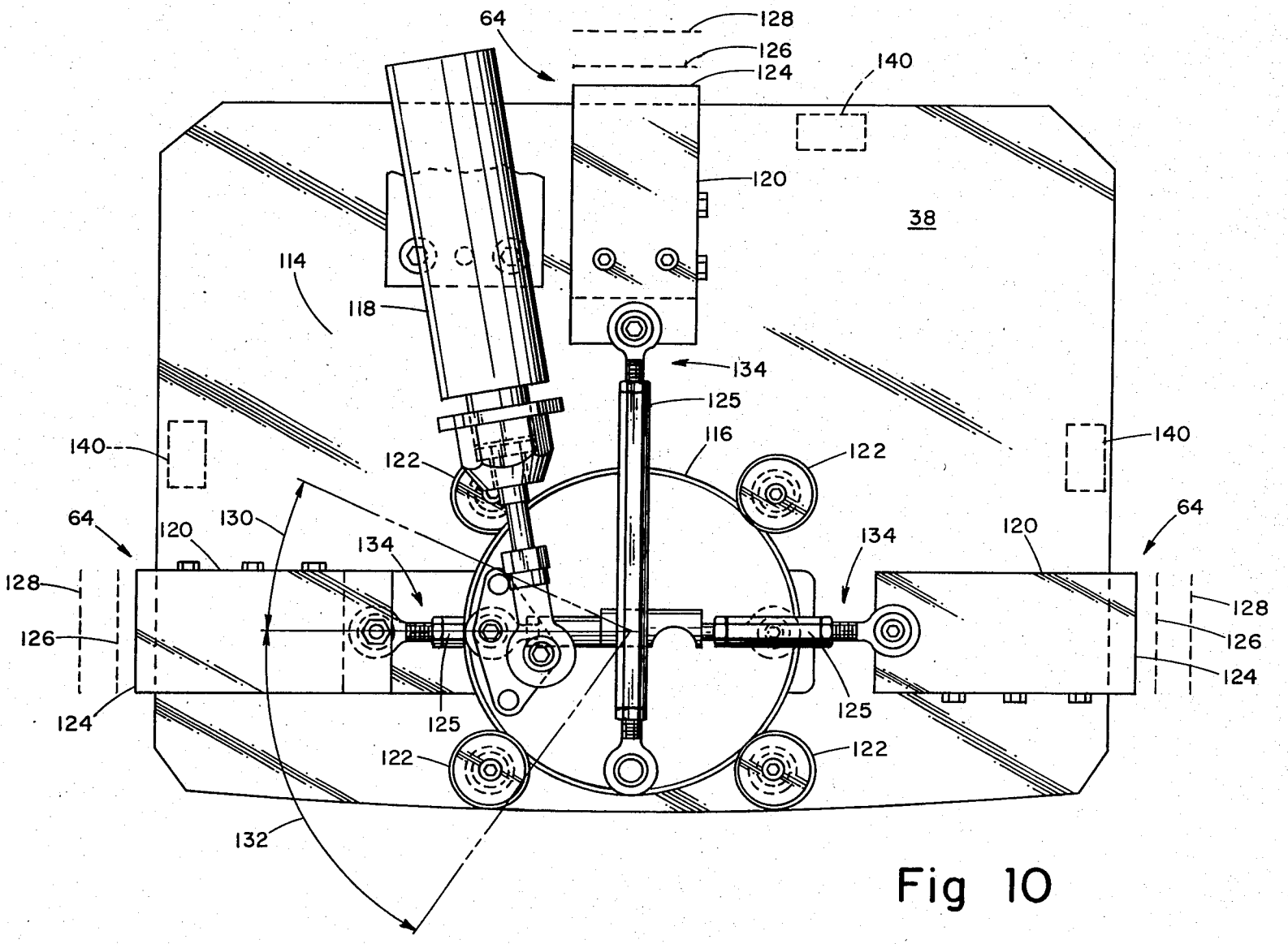
FIG. 10 is a plan view of an activating mechanism taken along lines 10—10 of FIG. 3; and, FIGS. 11A and 11B comprise a top view and a side view respectively of a spring depressor component according to the invention.

As described, spring depressor means 64, indicated in FIG. 5 as being three in number by way of example, have three positions: fully opened, mid-position, fully closed. The three positions are indicated in FIG. 10, which is a plan view of spring depressor mechanism 114. The depiction is a view looking along lines 10—10 of FIG. 3. Top and side views of spring depressor means in 64 are shown by FIGS. 11A and 11B.

The primary components of spring depressor actuator mechanism 114 include cam 116, which is caused to rotate by pneumatic cylinder 118. Three sliding members 120 are linked to cam 116 as depicted; at the distal ends of sliding members 120 are attached the spring depressor means 64, which are not visible in the FIG. 10 bottom view depiction. Idler wheels 122 provide for stabilizing the cam 116.

The spring depressors 64 are indicated as being in fully closed position 124, as depicted by fully inboard depiction of sliding members 120. Pneumatic cylinder 118 rotates cam 116 to provide the three positions 124, 126 and 128 of the three spring depressor means 64; that is, fully closed, mid-position and fully opened, respectively, with excursions as indicated by the dash lines.

Pneumatic cylinder 118 is a double-action device providing three fixed positions in response to automatic solenoid valve control means (not indicated) well-known in the art. In FIG. 10, the spring depressor actuator mechanism 114 is shown as having established the spring depressors 64 in fully closed position 124. It will be noted that the members 125 that link the spring depressors 64 with the cam 116 lie across cam 116. Retraction of the piston of cylinder 118 rotates cam 116 in a clockwise position about 25 degrees, as indicated by arrow 130, resulting in the outward movement of spring depressors 64 to mid-positions 126 to provide a clearance of about 20 mils between the springs 70 with respect to detents 80. Extension of the piston of cylinder 118 results in rotation of cam 116 in a counterclockwise direction about 55 degrees, providing further outward movement of spring depressors 64 to fully open positions 128, wherein the clearance between the springs 70 and detents 80 is about 250 mils.

The excursion of the spring depressors from fully open position 128 to fully closed position 124 is typically about 0.560 inch, and the excursion from fully closed position 124 to the mid-position 126 is typically about 0.190 inch.

Pneumatic cylinder 118 may be that supplied by Allenair Corporation, Mineola, N.Y. (or an equivalent). The Allenair Corporation designation is cylinder number AP-$1\frac{1}{2}\times\frac{7}{8}\times 2$ 1/16-D, DCC=3/8-24.

The excursion of the spring depressors 64 is regulated by screw/locknut stroke adjustment means 134 on linking members 125. Further adjustments are provided for positioning the spring depressors 64, as indicated by FIGS. 11A and 11B (spring depressor 64 is depicted in FIG. 11B as being inverted from its normal operating position). Horizontal slide means 136 provide for adjustment of the spring depressors 64 in the horizontal direction, while vertical slide means 138 provides for adjustment of the spring depressors 64 in a vertical direction. The distance detent 80 of spring depressor means 64 extends above platen means 38 is about 600 mils.

The placing of the metallic shadow mask on platen means 38, as installed by the operator or by automated pick-and-place equipment, is sensed by three electrical proximity-type metal-sensing switches which initiate subsequent operations. The location of mask-detecting switches 140 is on the top surface of platen means 38, as indicated in FIG. 10. The switches may be, for example, of the type supplied by Namco Controls, Cleveland, Ohio under the designatioh series EE520-5 static switch. The placing of a glass face panel on table means 54 is also sensed. The location of the panel-detecting switches 142, which are able to detect non-metallic materials such as the glass of the panel, is indicated in FIG. 5; the switches are shown as being two in number. The switches 142 may be of the air-proximity type such as those manufactured by Crouzet (France), supplied by Miller Fluid Corporation, Bensenville, Ill.

The use of panel and mask position sensors; that is, three mask sensing switches 140, and the two glass panel sensing air-proximity switches 142 provide these operating benefits:

1. If the mask inserter is loaded and unloaded manually, there is no need for the operator to initiate the sequence of operation as by push buttons, for example, because the presence of the mask and panel initiate the functions. Similarly, no initiation signals need be supplied to the automation control circuit.

2. The apparatus detects improper or incomplete placement of mask or panel. For example, if a defective mask should hang up on a mask-frame pre-locator, the associated sensing switches will detect the lack of proximity of the mask. The mask inserter will stop, an audible alarm will sound, and a warning light will indicate the origin of the fault.

3. A strip recorder can be connected to the apparatus according to the invention to monitor as many as twenty different operations of the apparatus for later review. If a non-insertion takes place, the reason can be pin-pointed.

The inventive method for inserting a mask in a panel is described in detail as follows.

Initial condition of apparatus: Elevator means 46 has raised platen means 38 to an upper assembly position 48 ready to receive a shadow mask 42.

Mask 42 is placed on platen means 38. Mask-frame prelocators 40 pre-locate mask 42 on platen means 38. Proper placement of mask 42 is sensed and verified by three mask-sensing switches 140, enabling the next operation.

Elevator means 46 lowers mask 42 to lower, preassembly position 50. Tapered pin means 62 move inwardly to seek apertures 68 and locate the axes of the apertures in a first, substantially horizontal plane 74. The mask may be lifted and/or moved laterally as the tapered pin means 62 seek and locate the apertures 68.

Spring depressor means 64 depress springs 70. Detents 80 mate with indents 78 to lock apertures 68 at predetermined points 82 in the first horizontal plate 74. The springs 70 are fully depressed by movement of spring depressor 64 to fully closed position 124. The tapered pin means 62 retract when apertures 68 are locked by indent-detent coupling.

Face panel 56 is placed on table means 54 in the upper assembly position 48 by an operator or by automated pick-and-place equipment. Blocks 58 provide for prelocating panel 56. Placement of the panel 56 is sensed by air-proximity switches 142, enabling the next operation.

The V-groove tip means 88 locate position and cradle studs 84 to establish studs 84 in a substantially horizontal second plane 86, with the axes of the studs 84 in approximate vertical alignment with the predetermined points 82.

Elevator means 46 raises mask 42 to the upper assembly position 48, translating first and second planes 74 to 86 into approximate coplanarity, and the axes of the studs 84 and apertures 68 into approximate coincidence.

The springs 70 are released by the movement of the spring depressor means 64 to mid-position 126. The springs 70 are caused to rest against V-groove type means 88 and in partial engagement with studs 84. The providing of a mid-position 126 of the spring depressors 64 prevents the spring depressors from contacting and perhaps chipping or otherwise damaging the inside surface of the flange 57 of the face panel 56. Elevator means 46 lowers platen means 48 to the lower-preassembly position 50 and spring depressors 64 moves to the fully open position 128. Studs 84 are uncradled by withdrawal of the V-groove tip means 88, to effect full engagment of apertures 78 with studs 84. The assembled mask and panel is lifted from the table means 54 by an operator or by automated pick-and-place equipment. Elevator means 46 raises platen means 38 to the upper assembly position 48 to receive another mask for repeating the mask-inserter operation.

The method according to the invention provides for nullifying the dimensional deviations of the mask and panel by locking the axes of the apertures and cradling the studs in approximate coaxial coincidence for positive, consistent and unequivocal mutual engagement of the apertures and studs upon release of the springs.

Other changes may be made in the above-described apparatus and method without departing from the true spirit and scope of the invention herein involved. It is intended therefore that the subject matter of the aforegoing depiction shall be interpreted as illustrative and not in a limiting sense.

We claim:

1. For use in the manufacture of a color cathode ray picture tube having a substantially rectangular face panel including a rearwardly extending flange with a plurality of inwardly extending studs, and with a shadow mask with frame suspended in precise adjacency to said panel by an equal plurality of leaf-type springs extending from said frame, the distal ends of each of said springs having an aperture for detachably engaging an associated one of said studs and an indent adjacent to said apertures for locking, in conjunction with an associated detent, said apertures at predetermined points, said mask and said panel being subject to dimensional deviations which preclude unequivocal engagement of said apertures with said studs, apparatus for inserting said mask in said panel, comprising:

platen means with mask frame-prelocating means for receiving and approximately locating said mask, convex-sideup, on said platen means;

elevator means for raising and lower said platen means and said mask between an upper assembly position and a lower, pre-assembly position;

table means in said upper assembly position for receiving and approximately locating said panel, convex-sideup, with respect to said mask, said table means having an opening for receiving said platen means in approximate coplanarity when said platen means is raised by said elevator means into said upper assembly position;

means for preparing said mask for engagement with said panel when said platen means and said mask is in said lower pre-assembly position, said means for preparing said mask for engagement including:

tapered pin means for seeking said spring apertures and locating the axes of said apertures in a first, substantially horizontal plane, including means for moving said tapered pin means into and away from engagement with said apertures;

spring depressor means for clamping each of said springs against said mask frame to preserve the location of said axes of said apertures in said first horizontal plane, said spring depressor means including said detents for mating with assigned ones of said indents to lock said apertures at said predetermined points in said first, substantially horizontal plane, to simultaneously horizontally immobilize said frame, and to maintain such horizontal immobility during any subsequent translation of said frame;

stud locating means for establishing the studs of said panel in a substantially horizontal second plane in said upper assembly position, said stud-locating means including V-groove tip means for locating, positioning and cradling said studs in said second plane with the axes of said studs in approximate vertical alignment with said predetermined points;

means for actuating said elevator means for raising said mask to said upper assembly position to translate said first and second planes into approximate coplanarity, and bring the axes of said apertures into approximate coincidence with the axes of said studs;

means for releasing said spring depressor means to cause said springs to rest against said V-groove tip means and to permit at least partial engagement of said apertures of said springs with said studs;

means for withdrawing said V-groove tip means to uncradle said studs and effect full engagement of said apertures of said springs with said studs;

such that dimensional deviations of said mask and said panel are nullified by locating and locking the axes of said apertures and positioning and cradling said studs in approximate coaxial coincidence before releasing said spring depressor means to provide positive, consistent and unequivocal mutual engagement of said apertures and said studs.

2. For use in the manufacture of a color cathode ray tube having a substantially rectangular face panel including a rearwardly extending flange with a plurality of inwardly extending studs, and with a shadow mask with frame suspended in precise adjacency to said panel by an equal plurality of leaf-type springs extending from said frame, the distal end of each of said springs having an aperture for detachably engaging an associated one of said studs, and with a spring-locating indent adjacent to each aperture for mating with a detent on associated spring depressor means forming a part of a mask inserter apparatus, a method for inserting said mask in said panel comprising:

seeking said spring apertures and locating said apertures in a first, substantially horizontal, plane in a lower pre-assembly position;

depressing said springs by said spring depressor means and mating said indents and detents to lock said apertures at predetermined points in said first horizontal plane, to simultaneously horizontally immobilize said mask frame and to maintain such horizontal immobility during any subsequent translation of said frame;

locating, positioning and cradling said studs in a substantially horizontal second plane in an upper assembly position, with the axes of said studs in approximate vertical alignment with said predetermined points;

raising said mask to said upper assembly position to translate said first and second planes into approximate coplanarity and bring the axes of said studs and said apertures into approximate coincidence;

releasing said spring depressor means to permit partial engagement of said apertures of said springs with said studs;

uncradling said studs to provide full engagement of said apertures with said studs;

such that dimensional deviations of said mask and said panel are nullified by locating and locking the axes of said apertures and positioning and cradling said studs in approximate coaxial coincidence before releasing said springs to provide positive, consistent and unequivocal mutual engagement of said apertures and said studs.

* * * * *